US005947742A

United States Patent [19]

Katayama

[11] Patent Number: 5,947,742

[45] **Date of Patent: *Sep. 7, 1999**

[54] METHOD FOR TEACHING BODY MOTIONS

[75] Inventor: Muneomi Katayama, Tokyo, Japan

[73] Assignee: Midori Katayama, Tokyo, Japan

[ * ] Notice: This patent is subject to a terminal disclaimer.

[21] Appl. No.: 08/970,104

[22] Filed: Nov. 13, 1997

Related U.S. Application Data

[63] Continuation of application No. 08/487,164, Jun. 7, 1995, Pat. No. 5,857,855, which is a continuation of application No. 08/103,671, Aug. 10, 1993, abandoned.

[51] Int. Cl.[6] ..... A63B 69/36; G06F 15/44

[52] U.S. Cl. ..... 434/247; 434/252; 473/266; 473/409

[58] Field of Search ..... 473/207–209, 473/219–222, 266–267, 409; 463/1, 7, 30–31; 434/247, 252, 257–258; 364/410.1

[56] References Cited

U.S. PATENT DOCUMENTS

| | | | |
|---|---|---|---|
| 4,137,566 | 1/1979 | Haas et al. . | |
| 5,249,967 | 10/1993 | O'Leary et al. | 434/247 |
| 5,297,796 | 3/1994 | Peterson | 473/221 |
| 5,333,061 | 7/1994 | Nakishima et al. | 358/335 |
| 5,486,001 | 1/1996 | Baker | 434/252 |
| 5,857,855 | 1/1999 | Katayama | 434/247 |

*Primary Examiner*—Jessica J. Harrison
*Assistant Examiner*—Mark A Sager
*Attorney, Agent, or Firm*—Oblon, Spivak, McClelland, Maier & Neustadt, P.C.

[57] ABSTRACT

The invention relates to a method for teaching the basic gesture for sports, performances or behaviors. A preferred teaching method comprises the steps of taking pictures of trainees as playing sports and making performances and other mannerisms with a video camera, giving guidances to them on the spot while analyzing the video image screens, sometimes, in comparison with the gestures made by a trainer playing sports, and making performances and other mannerisms to make the trainees understand the correct forms and timings of the gestures or movements of the body and members.

3 Claims, 13 Drawing Sheets

| | |
|---|---|
| | ADDRESS |
| A | DISTANCE FROM BALL |
| B | GRIPPING POWER |
| A | KNEES |
| B | CLUB FACE |
| C | ANGLE AGAINST FLAG |

METHOD FOR TEACHING BODY MOTIONS

This is a Continuation of application Ser. No. 08/487,164 filed on Jun. 7, 1995, now U.S. Pat. No. 5,857,855, which is a Continuation of Ser. No. 08/103,671, filed Aug. 10, 1993, now abandoned.

BACKGROUND OF THE INVENTION

This invention relates a method for teaching the basic gestures for sports, performances or behaviors.

In a conventional method for teaching the basic gestures for sports, performances or behaviors, the trainer typically makes an exemplary performance and then has the trainee make his or her performance, and points out their differences orally or physically to the trainee. Various kinds of media are getting popular where the trainer's performances or gestures are recorded with guidances orally or on paper. U.S. Pat. No. 5,184,295 issuing Feb. 2, 1993 and herein incorporated by reference, discloses a method including having an exemplary performances or gestures recorded in a video image and overlying the video image over trainee's ones by electronic computation to produce a three-dimensional image for helping teaching performances. The disclosed method involving prerecorded images of exemplary performances did not permit specially effective teaching for trainees of particular ages or body strengths, nor stepwise teaching for the individual trainees with various steps of achievements. The inventors made an invention where a trainee's performance is taken as a video image and then is regenerated on a CRT screen in a still picture on which the optimal range of movement of the body or its members and the basic lines or references for the optimal form can be shown, as previously filed and disclosed in U.S. Pat. No. 5,333,061, herein incorporated by reference. In the teaching situation where the trainer makes an exemplary action or performance under the presence of the trainee who then tries to make a performance as guided, a method for showing or explaining the differences therebetween was known in which the trainer's and trainee's performances are pictured in 6 to 8 frames in time sequence with a camera with a plurality of lenses and instantly processable film such as Polaroid (registered trademark) film for making comparative analysis. Although this method permits picture of the performances to be immediately made because of the characteristics of the photosensitive material, it turned out difficult to make the pictures of two persons's actions on separate films in synchronism with each other. The method has mostly not used for making comparative analysis between the trainer's and trainee's forms or gestures. No teaching method has not been known which permits comparison of the two persons's actions and gestures on the spot, thus enabling effectively explaining and questioning thereof.

SUMMARY OF THE INVENTION

According to the invention, a teaching method is provided which comprises the steps of imaging the trainer and trainee as playing sports or making performances or actions in video images separately, and reproducing the video images on the same video Display screen for comparative analysis between the two persons's gestures to tell differences of the gestures to the trainee.

According to another feature of the invention, a teaching method is provided which comprises the step of simultaneously reproducing two non-overlapping images of the trainer and trainee as playing sports or making performances or actions on the same video display screen simultaneously, the images being in a motion picture to tell the trainee the difference in their gestures.

According to still another feature of the invention, a teaching method is provided which comprises the step of simultaneously reproducing two non-overlapping images of the trainer and trainee while playing sports or making performances or actions on the same video display screen simultaneously, the images being in a motion picture to tell the trainee the chronological difference of their gestures.

According to the feature of the invention, a teaching method is provided which comprises the step of simultaneously reproducing two non-overlapping images of the trainer and trainee as playing sports or making performances or actions on the same video display screen simultaneously, the images being in a still picture to tell the trainee the difference of their gestures.

According to the feature of the invention, a teaching method is provided which comprises the step of simultaneously reproducing two non-overlapping images of the trainer and trainee as playing sports or making performances or actions on the same video display screen simultaneously, one of the images being in a motion picture and the other in a still picture to tell the trainee the relationship of their gestures.

According to the feature of the invention, a teaching method is provided which comprises the step of simultaneously reproducing two non-overlapping images of the same person as playing sports or making performances or actions on the same video display screen simultaneously, one of the images being in a moving picture and the other in a still picture to tell the trainee the relationship of the gestures as shown therein.

According to the feature of the invention, a ?teaching method IS provided which comprises the step of simultaneously reproducing two non-overlapping images of the same person as playing sports or making performances or actions on the same video display screen simultaneously, one of the images being in a motion picture and the other in a still picture to tell the trainee the deviations of the gestures as shown therein.

According to the feature of the invention, a teaching method is provided which comprises the step of simultaneously reproducing a moving picture of a person playing sports or making performances or actions, with a line or lines and/or a grid for visual reference for the observer to help understand the extent of gesture or movements during playing gestures as shown therein.

According to the feature of the invention, a teaching method is provided which comprises the steps of converting a motion picture of a person's playing sports or making performance into a series of per-frame still pictures, drawing in one of the pictures a basic line or lines featuring the posture of the body and/or the members as shown therein, replacing the frame picture by the subsequent one with the drawn line or lines remaining therein, drawing a basic line or lines featuring the posture of the body and/or members as shown in the subsequent frame, repeating the frame replacing and drawing steps, causing a group of the drawn basic lines to be reproduced on the screen without the per frame images of pictures of a person's playing sports or making performance to help the observer understanding the change thereof.

According to the feature of the invention, a teaching method is provided which comprises the steps of reproducing a still picture of a person as playing sports or making performances or actions and inputting characters and/or symbols to the still picture to help the observer understanding.

According to the feature of the invention, a teaching method is provided which comprises the steps of reproducing a still picture of a person as playing sports or making performances or actions and converting the picture image onto a hard copy for later reference to help the observer understanding.

According to the feature of the invention, a teaching method is provided which comprises the steps of imaging the performance by a sport player, performer or actor and the related performance action by the coplayer, coperformer or coactor simultaneously, and reproducing the resultant images in two non-overlapping pictures on the same screen, permitting the actions in correlation or collaboration to be observed in comparison for helping the observer understanding.

One of the advantages of this invention is to facilitate trainees understanding the trainer's guidances about golf swing and putting.

The other advantage of this invention is to facilitate trainees understanding trainer's guidances a batter's and pitcher's actions in baseball games.

The other advantage of this invention is to facilitate trainees understanding trainer's guidances about kicking actions in soccer games, such as corner kick and penalty kick.

The other advantage of this invention is to facilitate trainees understanding trainer's guidances about a server's actions in tennis.

The other advantage of this invention is to facilitate trainees understanding trainer's guidances about how to handle humps and gaps in skiing.

The other advantage of this invention is to facilitate trainees understanding trainer's guidances about the basics of dancing performance.

The other advantage of this invention is to facilitate trainees understanding trainer's guidances about behavior and gesture in tea ceremony.

The other advantage of this invention is to facilitate trainees understanding trainer's guidances about manipulation for flower arrangements.

BRIEF DESCRIPTION OF THE DRAWINGS

FIGS. 10A, 10B, 10C, 10D and 10E relate to a teaching method of the invention where an line image is used for analysis which is produced by drawing reference lines on a still picture of a performer, replacing the picture with a second still picture of the performer with the drawn line remaining, and inputting reference lines in the second picture and repeating these steps in a suitable number of times with all the picture being eventually erased with inputted lines being standing.

DETAILED DESCRIPTION OF THE PREFERRED EMBODIMENTS OF THE INVENTION

Figure 1:
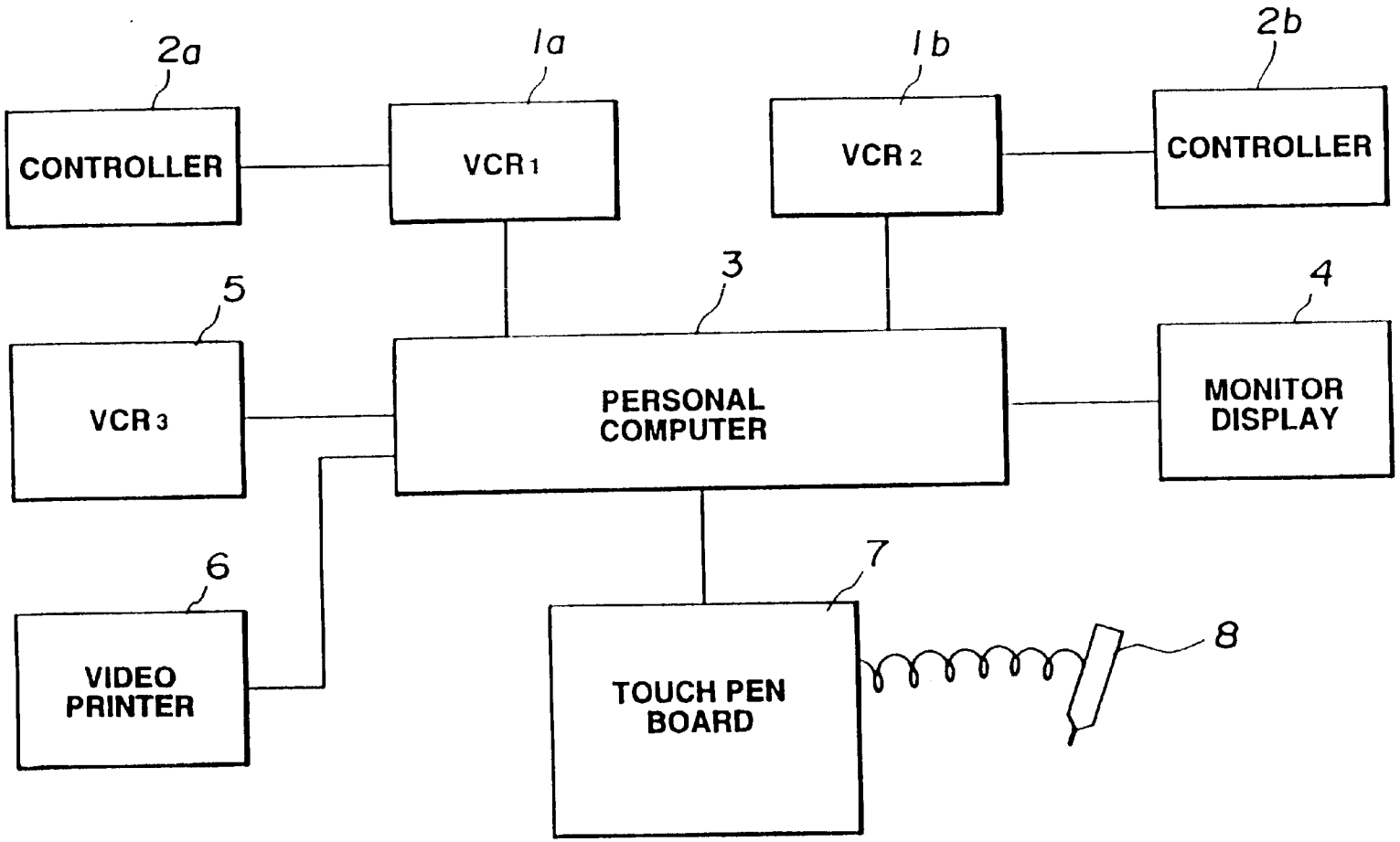
FIG. 1 is a block diagram showing equipment to be used by the invention.

There are shown in FIG. 1 equipment used in the invention comprising video cassette recorders 1*a* and 1*b* accommodating video tapes for comparison. They may be Sony's EV0-9650 for Hi-8 or alternatively any other comparable VCR. Recorders 1*a* and 1*b* have respective controllers 2*a* and 2*b* for searching for pictures and allowing a display of still pictures. The controllers are necessary for facilitating operations in the invention. The equipment further includes a personal computer 3 for making controls in the invention. It may NEC's PC-9801FA and alternatively any other comparable computer. This computer has two video signal processing boards and a control board added. A monitor display 4 displays a picture processed by the computer 3.

A video cassette recorder 5 may record an edited picture monitored at 4. The recorder is of any type which is capable of recording a broadcast TV program. A video printer 6 may be of any commercial available type to produce a hard copy of necessary picture on the monitor. A touchpen board 7 with a touchpen 8 thereon may be included as an alternative to the keyboard.

Figure 2:
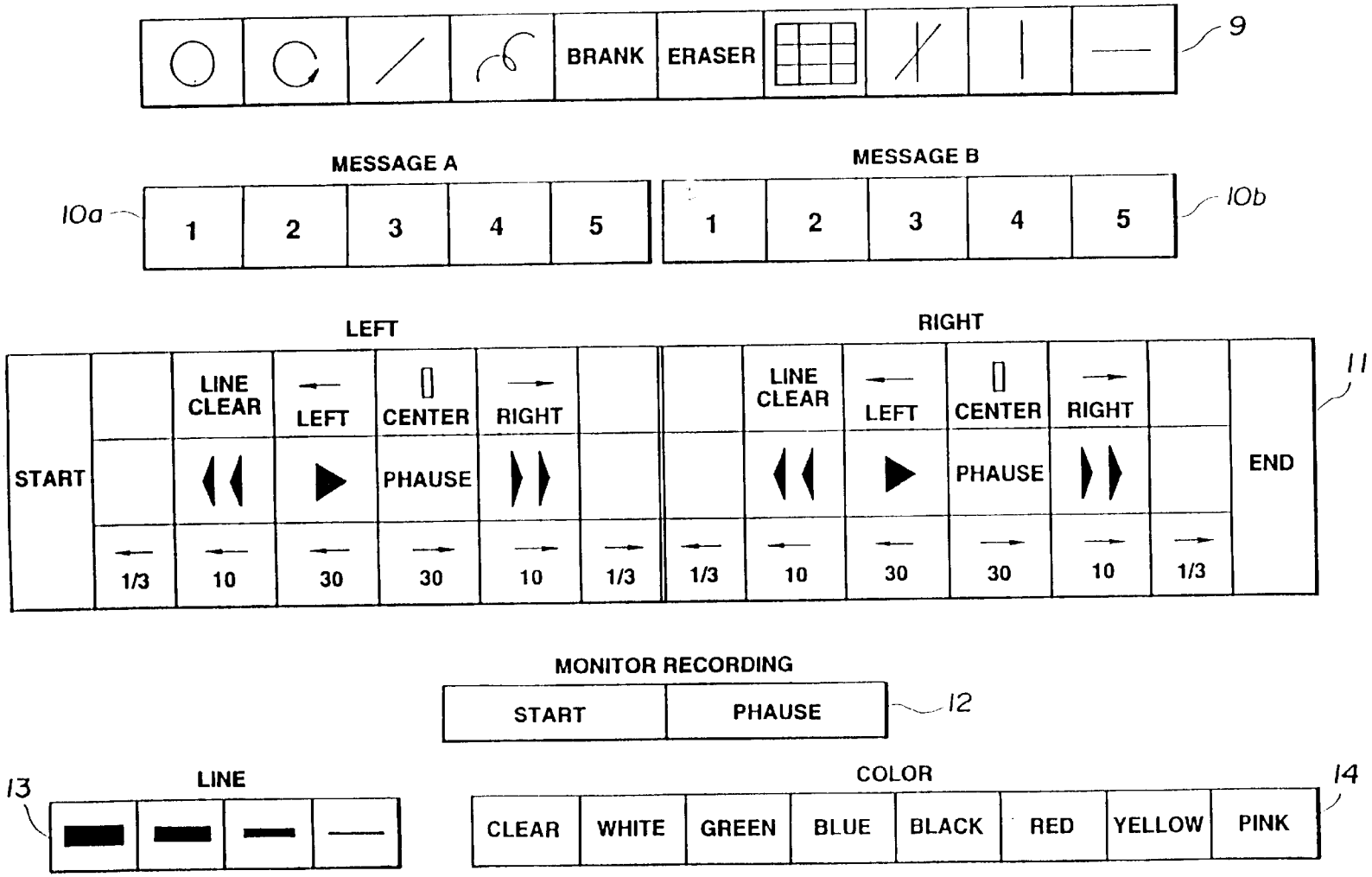
FIG. 2 shows several patterns of a pen-touch board replacing the keyboard incorporated in the equipment shown in FIG. 1.

FIG. 2 shows an embodiment of the touchpen board 7 shown in FIG. 1. The board includes sections 9 for selection of shapes to be inputted in the display, such as a circle, spiral, grid, line, line erase, blank and the like; 10*a* and 10*b* for selection and display of prestored messages; 11 for operation of video cassette recorders 1*a* and 1*b*, permitting selection of moving speed of moving pictures; 12 for operation of video cassette recorder 5 for edited video picture; 13 for selection of thickness of lines to be inputted to the display screen; and 14 for selection of color of lines to be inputted thereto.

Figure 3A:
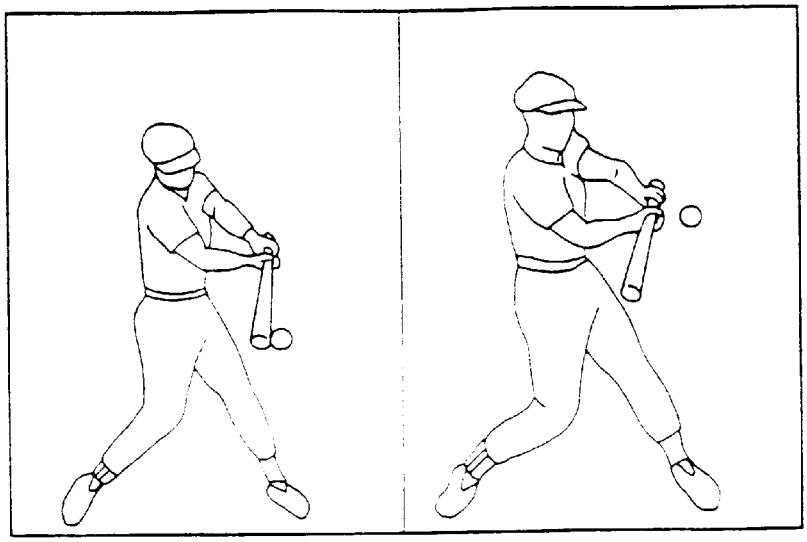
FIGS. 3A and 3B are pictures taken of a trainer's and trainee's under performance from the substantially same position and juxtaposed on the same screen.
Figure 3B:
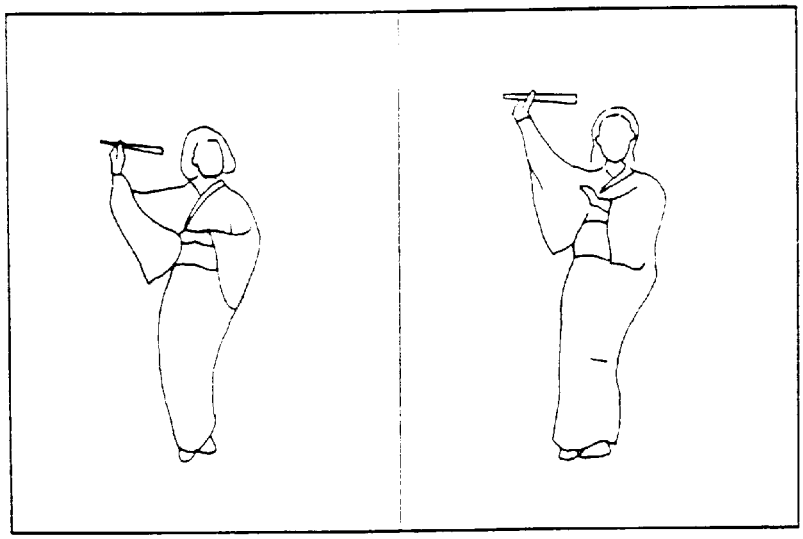

FIGS. 3A and 3B relate to an embodiment of the method according to the invention as applied to baseball and dancing performances, respectively. In FIG. 3A, the right side picture shows a trainer and at the left side, a trainee, for the purpose of telling the trainee about the correct form for batting a ball thrown by a pitcher. The form was shown in which the batter was about to strike the ball. It was evident that the left batter had his elbow stretched in this particular instance. The trainee was subjected to the teaching or counseling session using the apparatus of this invention and could understand the defect of his form and have his own actual form rectified. The method of the invention thus yielded good efficiency of training. In FIG. 3B, the juxtaposed pictures produced by the method of the invention applied to Japanese dancing performances clearly showed the trainer in the right picture was different from the trainee in the left one in the raising posture of the right arms. When the trainee was subjected to the teaching session by the method of the invention, she could easily understand the defect in her posture in contrast with her teacher's posture and have her own posture rectified, the method of the invention yielding good efficiency of training.

Figure 4:
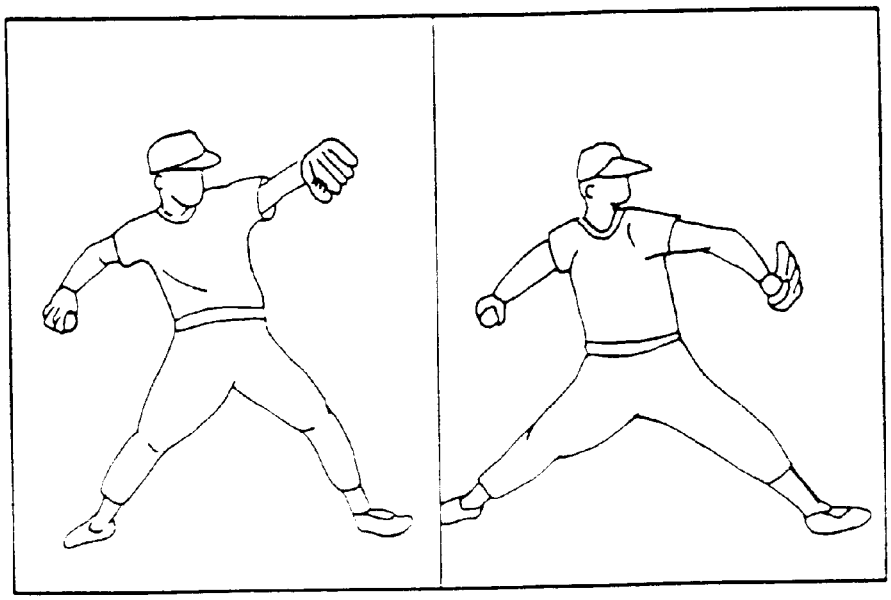
FIG. 4 shows pictures taken of a trainer and trainee performing from the substantially same position and juxtaposed on the same screen to tell the trainee the time difference.

FIG. 4 relates to an embodiment of the method according to the invention as applied to baseball training, showing a trainer and trainee in the right and left picture, respectively. This comparatively depicted in which position a pitcher has the opposite shoulder to that of the side where the ball was had by the hand when he has the ball in the rearmost position during the pitching stroke. It was evident that the trainee's left shoulder was stiff. When the trainee was subjected to the teaching session by the method of the invention, he could easily understand the defect and could rectify the stiffness and position of the shoulder to those of his trainer's shoulder as shown, the method of the invention achieving good efficiency of training.

Figure 5:
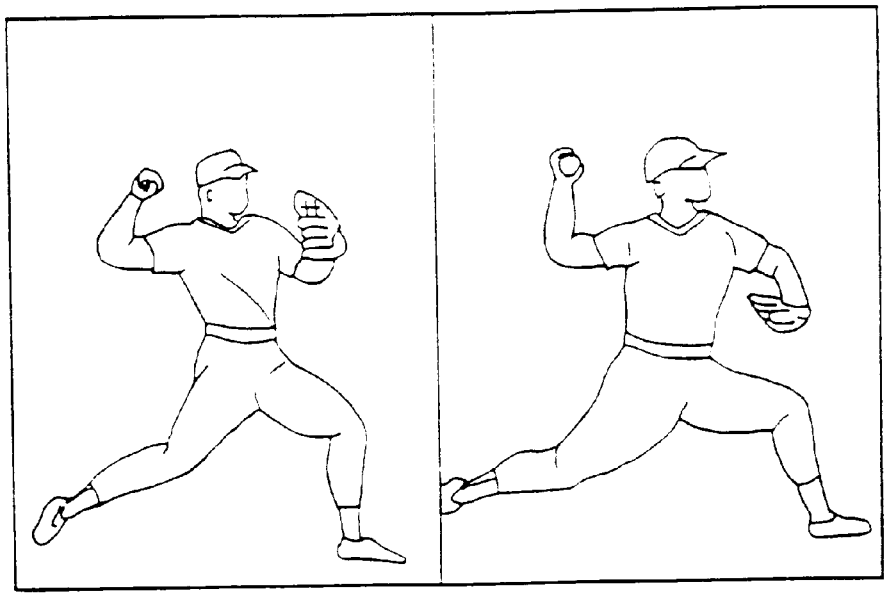
FIG. 5 shows pictures in a still image juxtaposed for comparative analysis.

FIG. 5 also relates to an embodiment of the method according to the invention as applied to baseball training, showing a trainer and trainee in the right and left picture, respectively. The method of invention could clearly monitor the pitcher was keeping his glove away from the body when the ball was thrown away from his hand. The position of the pitcher's glove has influences on the radius the shoulder makes during pitching stroke and the radius of the shoulder tends to be greater with the pitcher's glove being spaced from his body. When the trainee was subjected to the teaching session by the method of the invention, he could easily understand the defect and could keep his glove spaced from this body, the method of the invention achieving good efficiency of training.

Figure 6:
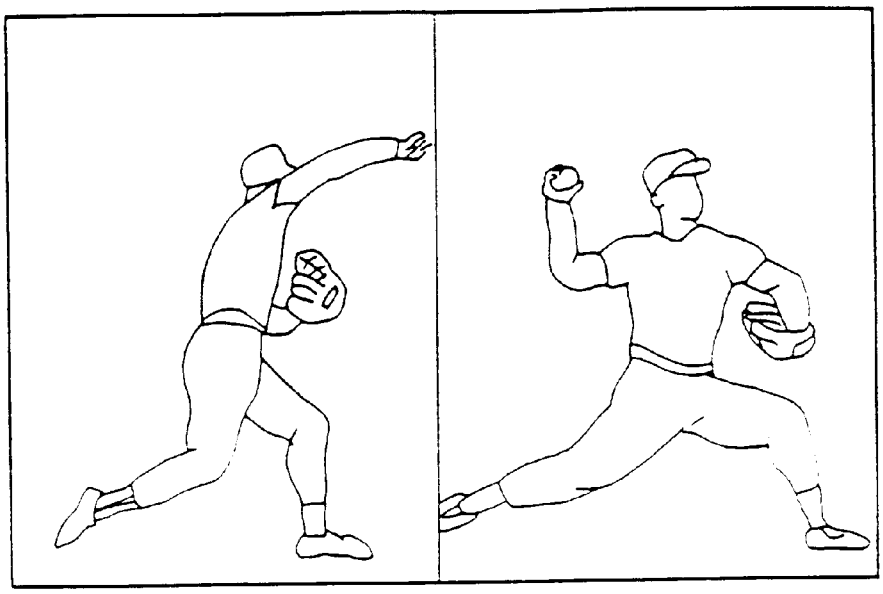
FIGS. 6 and 7A, 7B and 7C show juxtaposed pairs of pictures on the same screens, one being still and the other moving for comparative analysis.

FIG. 6 also relates to an embodiment of the method according to the invention as applied to baseball training, showing a trainer and trainee in the right and left picture, respectively. According to the invention, the trainer's picture was still with the trainee's being displayed in a moving picture, facilitating the trainee understanding his incorrect form in the various phases of the action. When the trainee was subjected to the teaching session by the method of the invention, he could easily understand the defect and could rectify his form, the method of the invention achieving good efficiency of training.

Figure 7A:
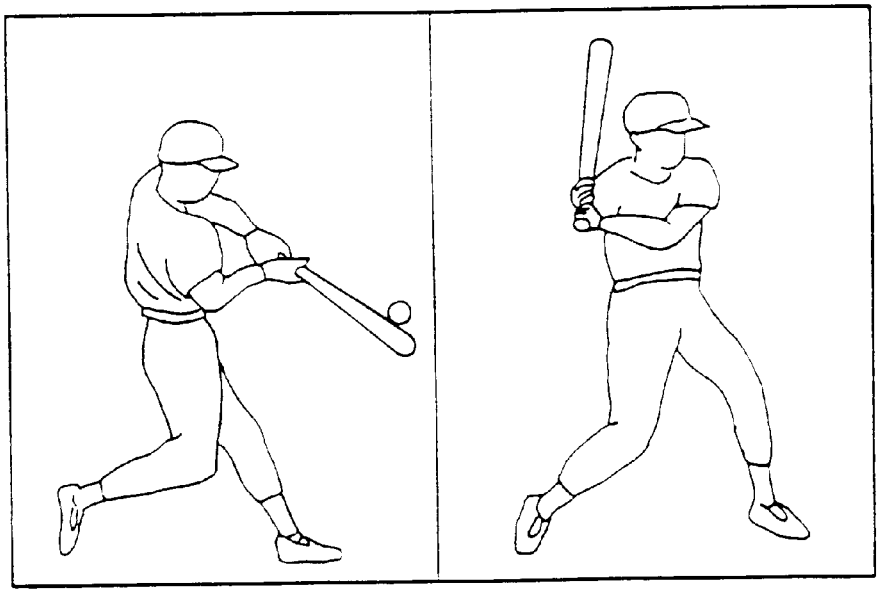
Figure 7B:
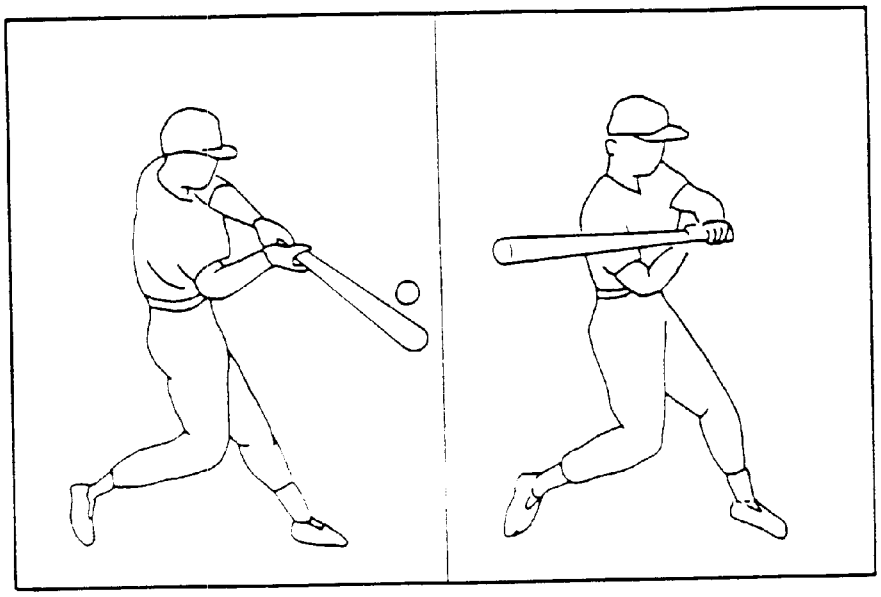
Figure 7C:
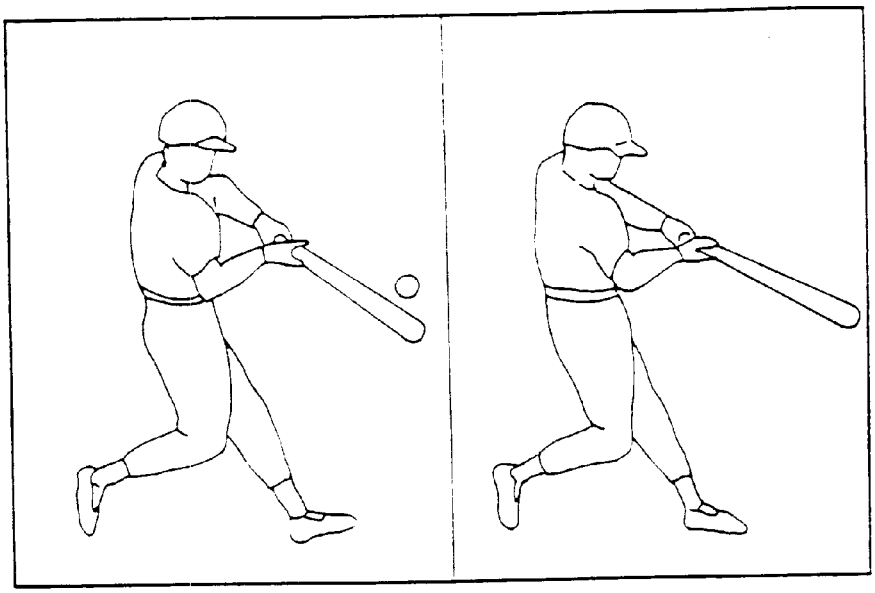

FIGS. 7A, 7B and 7C also relate to an embodiment of the method according to the invention as applied to baseball training, showing the same trainee both in the right and left pictures. According to the invention, the right picture showed a moving picture of the batting stroke action from the point that the batter stroke the ball up to the finished phase of batting, with the form at the striking phase in a still picture. When the trainee was thus subjected to the teaching session by the method of the invention, he could easily understand the defect by seeing relationship between the form in the still picture and the subsequent stroke, the method of the invention achieving good efficiency of training.

Figure 8:
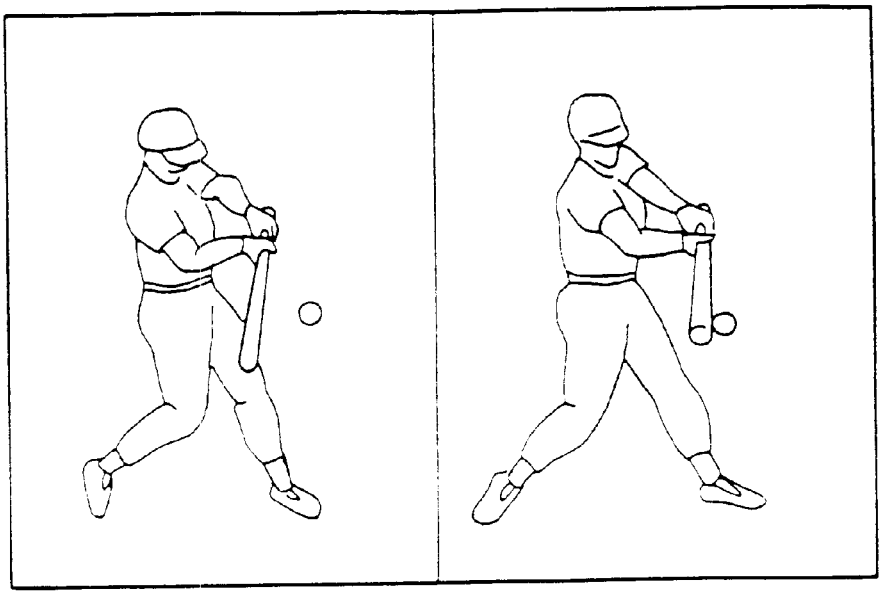
FIG. 8 shows a juxtaposed pair of pictures taken of a trainee's pre- and post-training performances for comparative analysis.

FIG. 8 also relates to an embodiment of the method according to the invention as applied to baseball training, showing the same trainee both in the right and left pictures. A trainee's action was pictured before the trainee was trained. After he was trained, his improved action was pictured. Pre-training and post-training actions were displayed in a juxtaposes pair of pictures to show the achievement degree to the trainee. Specifically, the trainee has the left elbow not sufficiently stretched before the training, which was shown in the right picture. After the trainee has this defect pointed out by the trainer and rectified it, he was taken a picture of and shown in the left picture in juxtaposition. When the trainee was thus subjected to the teaching session by the method of the invention, he could easily understand the deviation from the correct form, the method of the invention achieving good efficiency of straining.

Figure 9A:
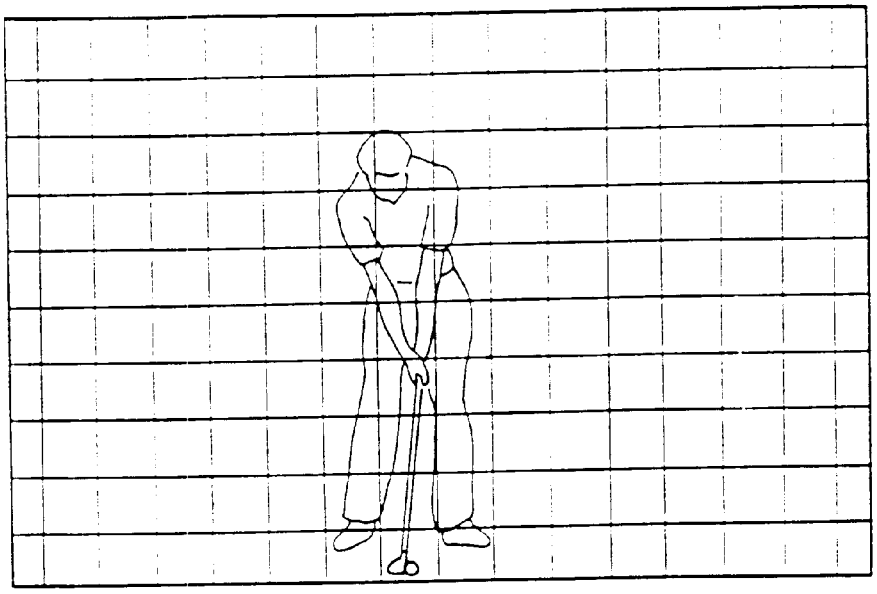
FIGS. 9A, 9B and 9C show picture, still or with motion, with grids and/or reference lines for analysis.
Figure 9B:
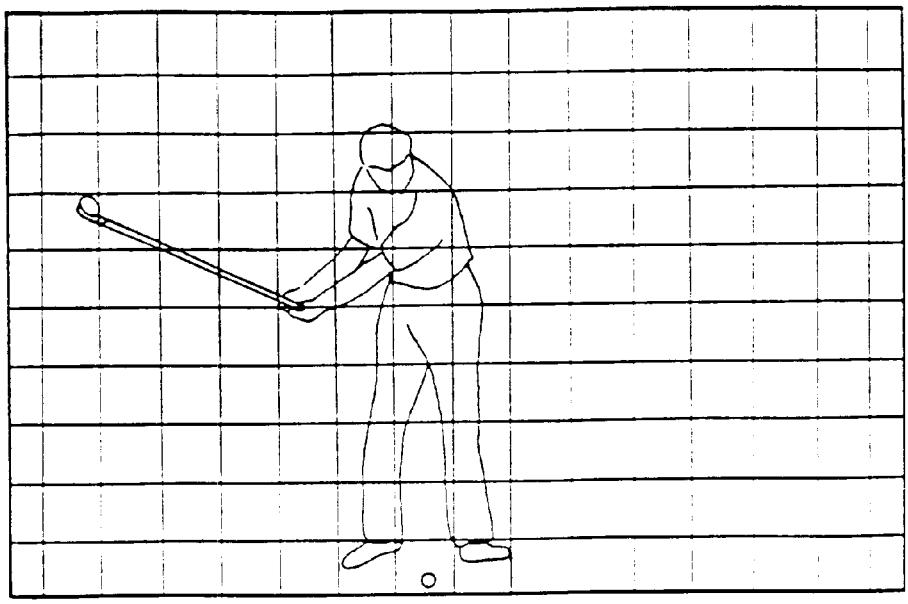
Figure 9C:
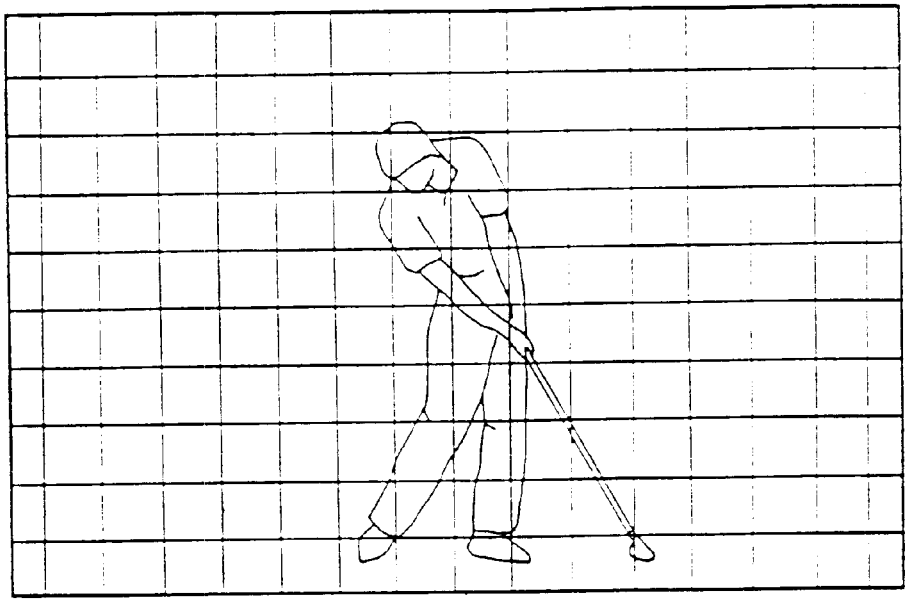
Figure 9D:
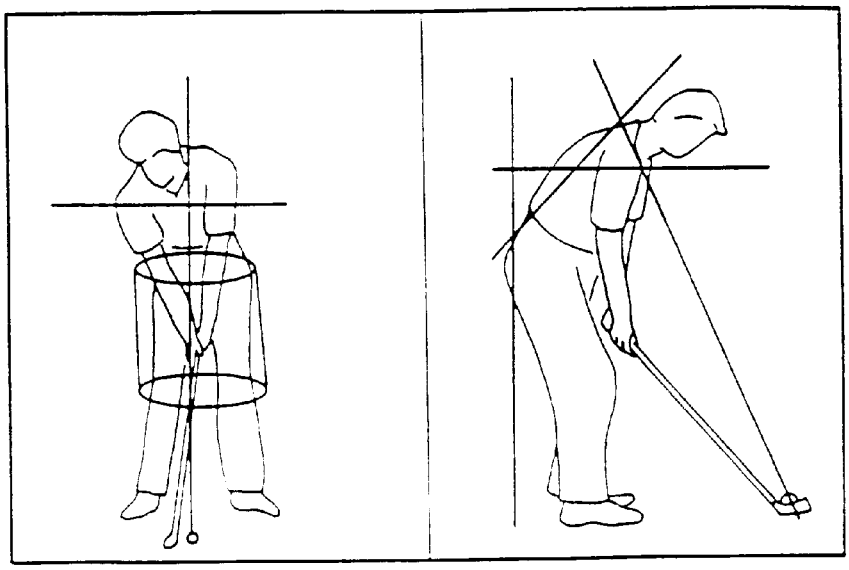
FIGS. 9D and 9E show a juxtaposed pair of pictures taken of the same performance at the different angle on the same screen for analysis.
Figure 9E:
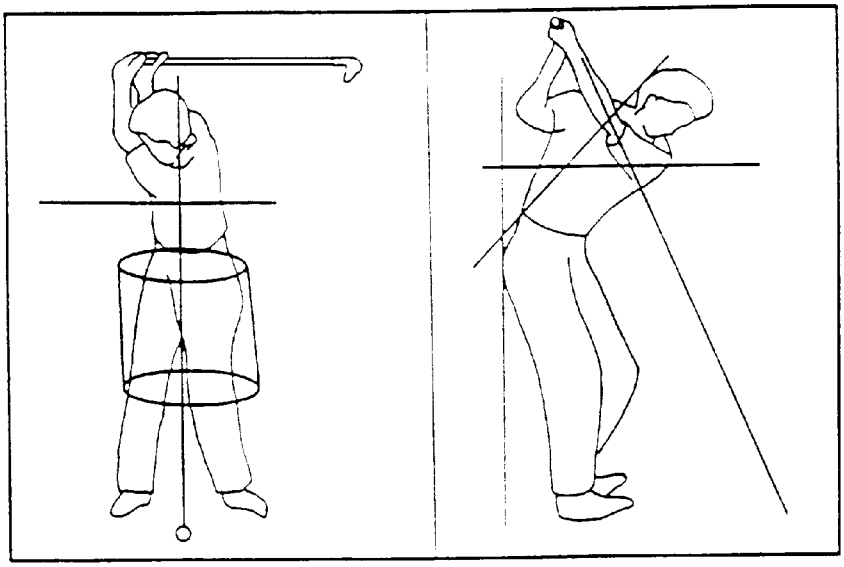

FIGS. 9A, 9B and 9C relate to an embodiment of the method according to the invention as applied to golf training. It is believed that the head be not displaced during the swing stroke. Practically, it would be often difficult to obtain the understanding how critical this principle is by seeing the swing stroke on the screen. This difficulty was eased by use of an overlapping grid on the screen. The forms at the time of address, take back and ball strike shown in FIGS. 9A, 9B and 9C, respectively, were presented to the trainee to enable understanding of the correct form, the method of the invention achieving good efficiency of training. As shown in FIGS. 9D and 9E where the form of the same trainee are depicted in a plurality of different angles in a non-overlapping juxtaposed pairs of screens, a number of lines and circle, instead of the grid, may be inputted on the screens to tell the inclination of the members and/or the range of movements thereof to the trainee. When the trainee was thus subjected to the teaching session by the method of the invention, he could easily understand the correct form, the method of the invention achieving good efficiency of training.

Figure 10A:
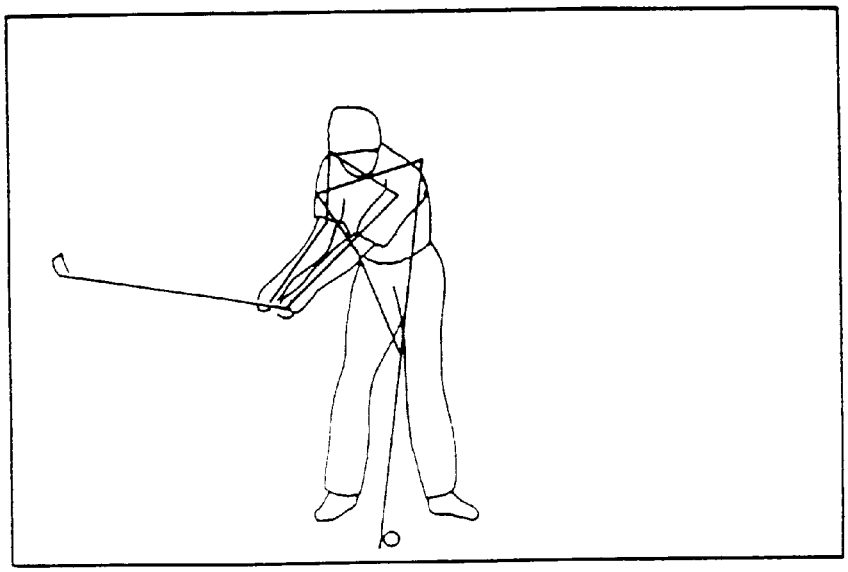
Figure 10B:
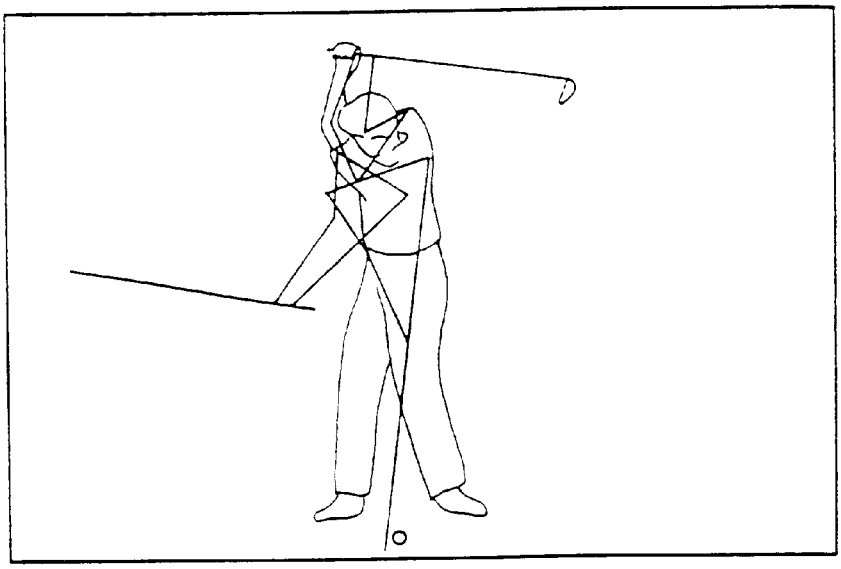
Figure 10C:
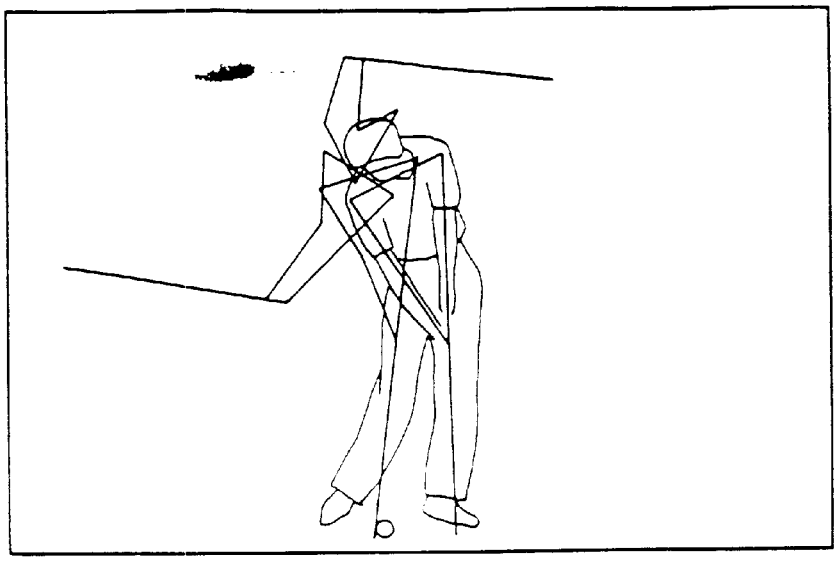
Figure 10D:
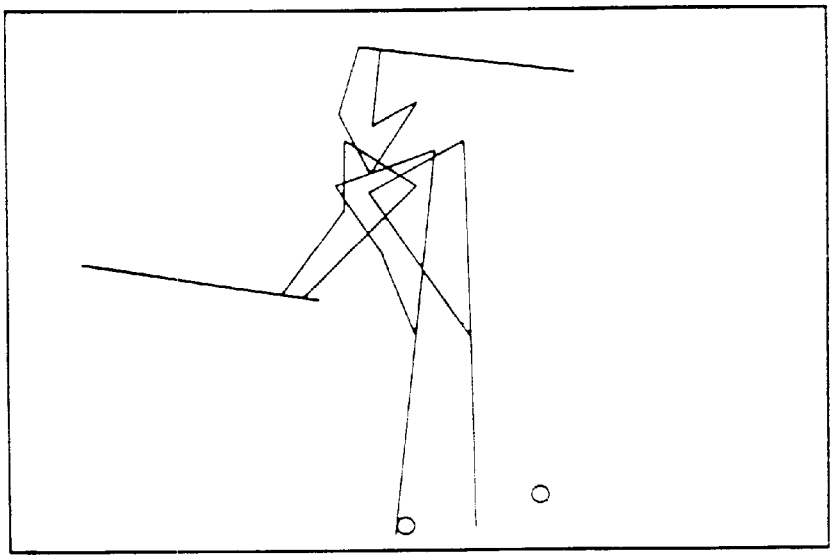

FIGS. 10A, 10B, 10C and 10D also relate to an embodiment of the method according to the invention as applied to golf training. In order to determine whether the swing form is correct or not, it is convenient to draw a line along the golfer's opposite shoulders, a pair of lines linking he opposite ends of the shoulder line to the hands, and a line linking the club grip and head. When the triangle formed by the lines linking the shoulders and hands is kept to be seen the same, the shot can be made with the correct swing. As shown in FIGS. 10A, 10B and 10C, the described lines were drawn on the screens, and then the pictures were erased. The resultant linear diagram may be displayed on the screen as shown in FIG. 10D, facilitating the trainee understanding the correct form. When the trainee was thus subjected to the teaching session by the method of the invention, he could easily understand the correct form, the method of the invention achieving good efficiency of training.

Figure 11A:
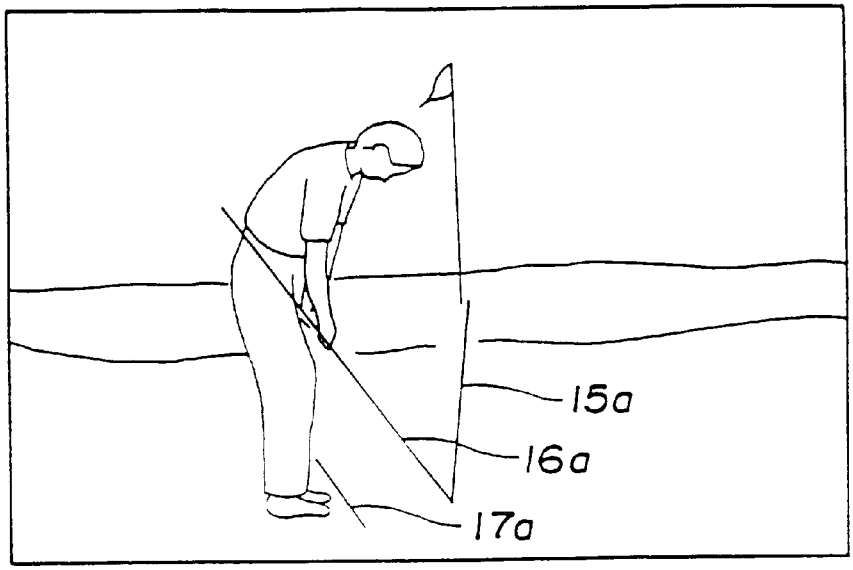
FIGS. 11A and 11B relate to a teaching method of the invention where reference lines drawn in a screen of moving picture to illustrate the deviation of a trainee's performance are used for analysis.
Figure 11B:
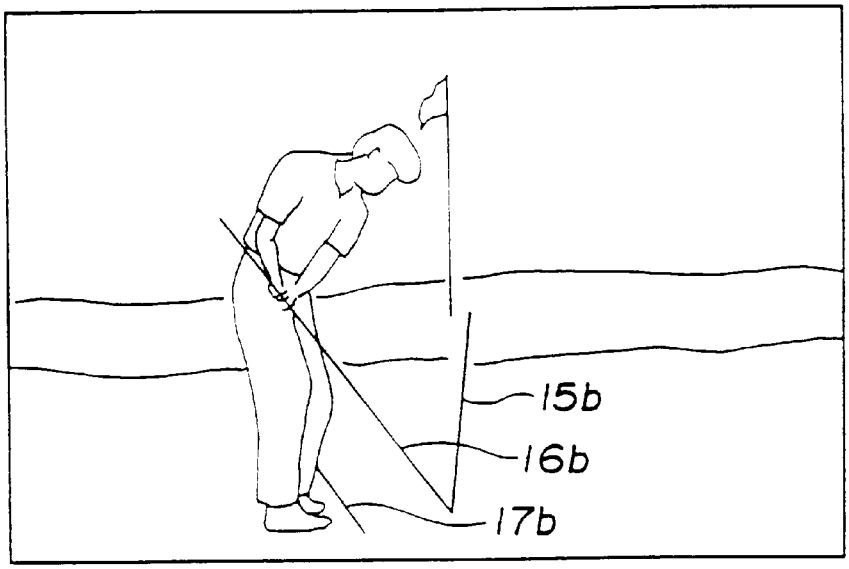

FIGS. 11A and 11B also relate to an embodiment of the method according to the invention as applied to golf training.

When a trainee is trained for approach shot according to the invention, lines 15*a,* 16*a* and 17*a* designating the direction of the ball, movement of the club head, and the stance, respectively, were drawn on the screen as in FIG. 11A. After the picture has been caused to proceed up to that of take sack as shown in FIG. 11*b* the trainer could show the trainee whether the take-back form was corrected in relation to the lines 15*a,* 16*a* and 17*a,* to make easy guidances. When the trainee was thus subjected to the teaching session by the method of the invention, he could easily understand the correct form, the method of the invention achieving good efficiency of training.

Figure 12:
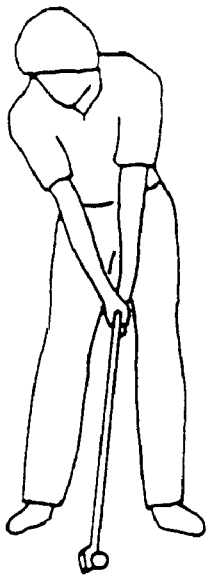
FIG. 12 shows a screen of a picture and other additional items of information for the conveniences of analysis.

FIG. 12 also relates to an embodiment of the method according to the invention as applied to golf training. As shown, any item indications may be selected from a set of predetermined characters and/or graphical representations and be displayed along with a still picture. The trainer may input his markings and/or remarks related to the form shown in the still picture, and may produce a hard copy of the display screen to be given to the trainee for facilitating understanding the correct from, the method of the invention achieving good efficiency of training.

Further, the invention provides a training method where the display screen is partitioned into two sections, one of which diagrammatically shows a strike zone, the baseball diamond, representations of the course of a ball entering the strike zone and the direction of the ball hit. The other section of the screen may show the form of the related batter. Alternatively, one section of the screen depicts the position of a golf cup and turf grain, and the other shows a golfer putting at the pin in a still picture. With the method of this invention, the trainer could teach the trainee or trainees how to strategically proceed with the game with the varying situations.

In the foregoing descriptions, the screen has been described as partitioned vertically. It is apparent that it may be partitioned horizontally or that partitioned segments may be varied in size.

What is claimed is:

1. A teaching method, which comprises:

taking a picture with a video camera of a direct, nonmirrored image of a trainer and trainee, said trainer and trainee facing said video camera while performing related actions;

simultaneously displaying said pictures of the trainer and trainee on a video display screen; and simultaneously comparing said pictures on new video display screen of the trainer and trainee to allow the trainee to understand differences in movement between the trainer and trainee.

2. The teaching method of claim 1, which comprises:

reproducing at least one of said pictures of the trainer and trainee wherein one of said pictures of the trainer and trainee comprises a moving motion picture and another of said pictures of the trainer and trainee comprises a still picture.

3. A teaching method, which comprises:

taking pictures of a direct, nonmirrored image of a trainer and trainee with a video camera, the trainer and trainee respectively facing said video camera and said trainer and trainee performing related actions from a location, a first picture of said pictures of the trainer and trainee comprising a still picture and a second picture of said pictures of said trainer and trainee comprising a motion picture so as to allow the trainee to understand relationships between said first picture and said second picture; and simultaneously displaying said pictures on a video display screen of the trainer and trainee, respectively, in at least a non-overlapping manner.

* * * * *